US010731353B1

(12) United States Patent
Lewis et al.

(10) Patent No.: US 10,731,353 B1
(45) Date of Patent: Aug. 4, 2020

(54) AWNING SYSTEM

(71) Applicants: Antonio Lewis, Pensacola, FL (US); Christine Lewis, Pensacola, FL (US)

(72) Inventors: Antonio Lewis, Pensacola, FL (US); Christine Lewis, Pensacola, FL (US)

( * ) Notice: Subject to any disclaimer, the term of this patent is extended or adjusted under 35 U.S.C. 154(b) by 315 days.

(21) Appl. No.: 15/835,455

(22) Filed: Dec. 8, 2017

Related U.S. Application Data

(60) Provisional application No. 62/456,150, filed on Feb. 8, 2017.

(51) Int. Cl.
*E04F 10/04* (2006.01)
*E04F 10/02* (2006.01)
*E04H 15/34* (2006.01)

(52) U.S. Cl.
CPC ..... *E04F 10/02* (2013.01); *E04F 10/04* (2013.01); *E04H 15/34* (2013.01)

(58) Field of Classification Search
CPC ..... E04B 1/5831; E04H 15/505; E04H 15/32; E04H 15/34; E04H 15/44; E04H 15/46; E04H 15/48; E04F 10/04; E04F 10/08; E04F 10/10
See application file for complete search history.

(56) References Cited

U.S. PATENT DOCUMENTS 3,061,055 A * 10/1962 Nijhuis ..... E04B 2/766 403/7
3,456,413 A * 7/1969 Fischer ..... A63H 33/084 52/591.1
3,830,033 A * 8/1974 Gahler ..... A01G 9/1407 52/831
3,901,612 A * 8/1975 Canin ..... F16B 7/187 403/189
4,071,990 A * 2/1978 Traber ..... B44C 7/022 403/231
4,101,226 A * 7/1978 Parisien ..... E04H 17/1413 403/4
4,192,112 A * 3/1980 Reilly, Sr. ..... E04F 10/02 160/46
4,641,805 A * 2/1987 Martensson, IV .. E04F 10/0618 248/223.41
4,692,847 A * 9/1987 Gandy ..... E04F 10/00 160/22
4,748,995 A * 6/1988 Viglione ..... E04F 10/04 135/130
4,813,196 A * 3/1989 Bokelund ..... E04H 1/1272 52/175
4,817,655 A * 4/1989 Brooks ..... E04H 15/58 135/119
4,865,066 A * 9/1989 Brooks ..... E04H 15/58 135/121

(Continued)

*Primary Examiner* — Daniel P Cahn
(74) *Attorney, Agent, or Firm* — Chris Tanner; FYPA PLLC

(57) ABSTRACT

An awning system having miter connectors suitable for attaching to portions of T-slot tubing members is disclosed. The awning system can be shipped by conventional shipping mechanisms, does not require welding, and does not require a flat-bed truck for transport. Also, the awning system can then be assembled and installed on-site, rather than being shipped in a fully pre-assembled state. The awning system uses proprietary tubing members and (in most embodiments) a miter connector to form an awning frame.

8 Claims, 19 Drawing Sheets

(56) References Cited

U.S. PATENT DOCUMENTS

| | | | | |
|---|---|---|---|---|
| 5,209,029 | A * | 5/1993 | Foerst | B63B 17/02 160/392 |
| 5,237,785 | A * | 8/1993 | Lukes | E04B 1/5831 160/391 |
| 6,481,177 | B1 * | 11/2002 | Wood | F16B 7/187 403/189 |
| 6,758,014 | B2 * | 7/2004 | Chen | A01G 9/14 52/63 |
| 7,806,622 | B2 * | 10/2010 | Stauss | F16B 7/187 403/381 |
| 9,016,972 | B2 * | 4/2015 | Oetlinger | F16B 12/50 403/252 |
| 2013/0131729 | A1 * | 5/2013 | Stauber | A61B 17/7035 606/267 |
| 2017/0241159 | A1 * | 8/2017 | Lyon | E04H 15/48 |
| 2019/0100937 | A1 * | 4/2019 | Amadardo | E04H 15/34 |

* cited by examiner these conventional terms are included here for reference and illustration, to help make this disclosure easier to understand Lean to rigid embodiment Lean to frame Shed frame Standard frame Awning system 100

Frame 102

(human fingers included for size-comparison)

AWNING SYSTEM

BACKGROUND OF THE INVENTION

Many types of awnings require being pre-assembled prior to shipping and installation. This provides a considerable amount of problems and greatly increases the expense of awning installations. Consequently it is desired to have an awning-assembly which can be shipped by conventional means, and then assembled and installed on-site, rather than being shipped in a pre-assembled state.

DETAILED DESCRIPTION OF THE PREFERRED EMBODIMENTS

Figure 1A:
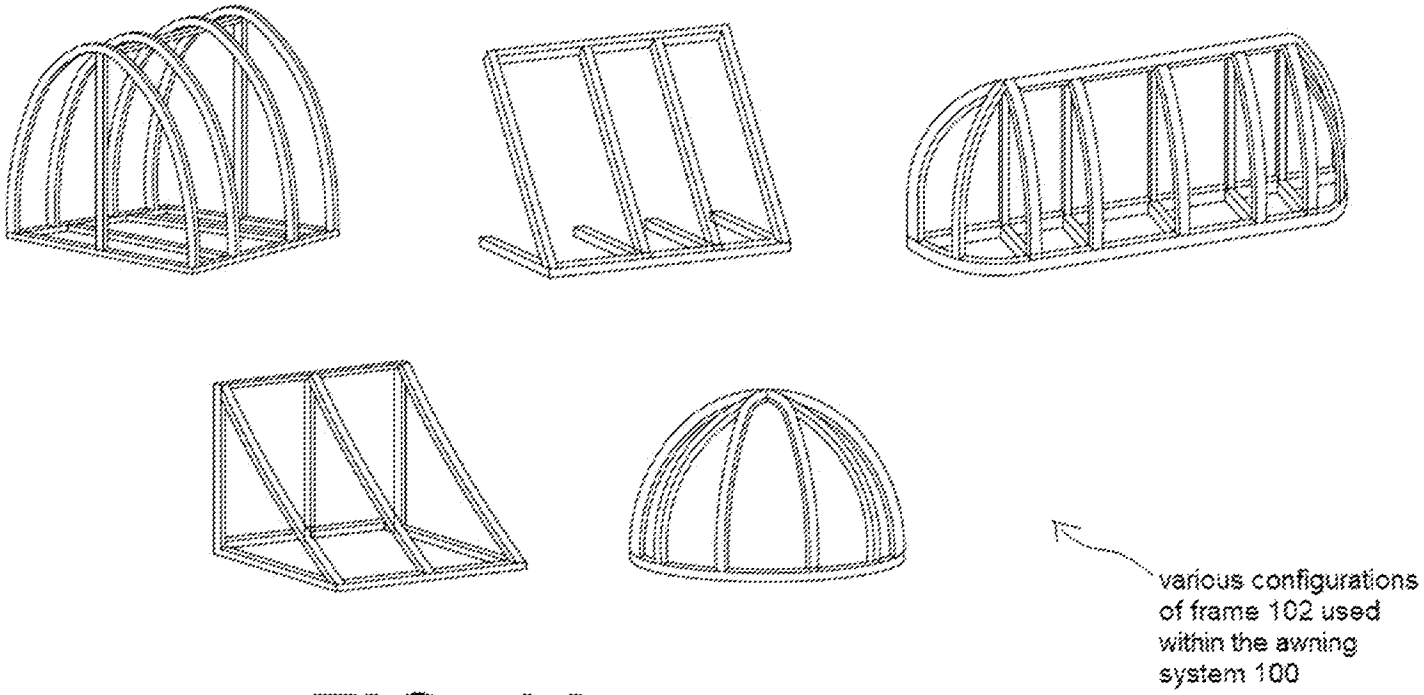
FIG. 1A shows some example frames for use within an awning system.
Figure 1B:
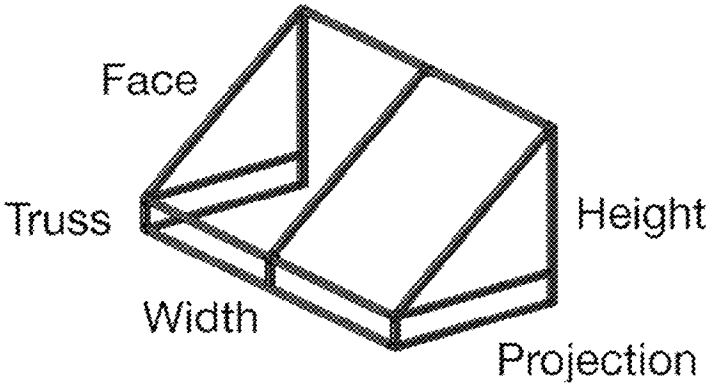
FIG. 1B (Prior Art)
FIGS. 1B and 1C (Prior Art) shows some conventional word-usage when referring to awnings in general.
Figure 1C:
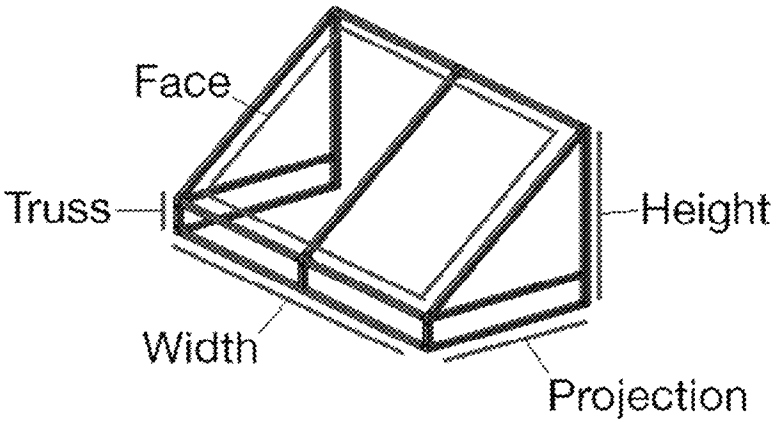
FIG. 1C (Prior Art)

FIG. 1A shows some example frames 102 for use within the awning system 100. FIG. 1B (Prior Art) shows some conventional word-usage when referring to awnings in general, including face, truss, width, height, and projection or projection arms. FIG. 1B is included herein mainly to make this disclosure easier to understand.

Figure 2A:
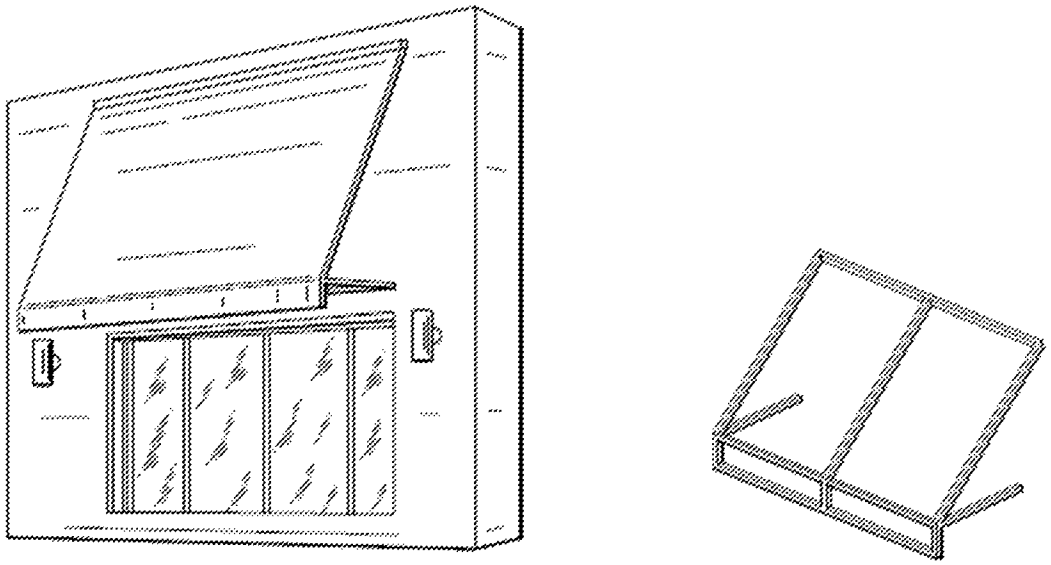
FIG. 2A shows a system with a lean-to frame.
Figure 2B:
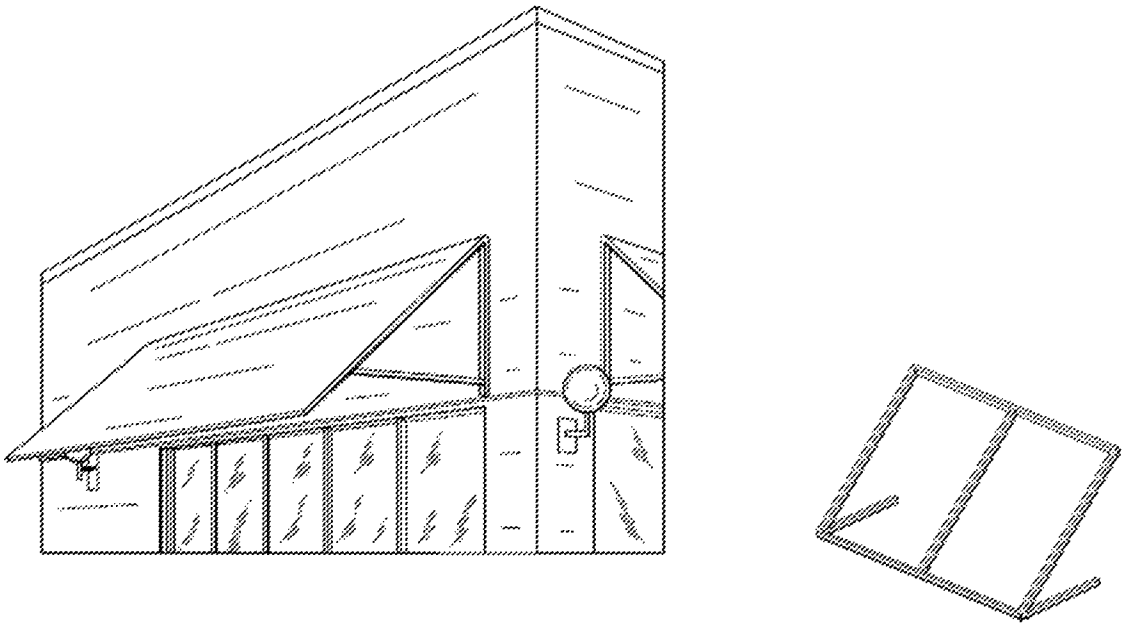
FIG. 2B shows a system with a lean-to rigid valence frame.
Figure 2C:
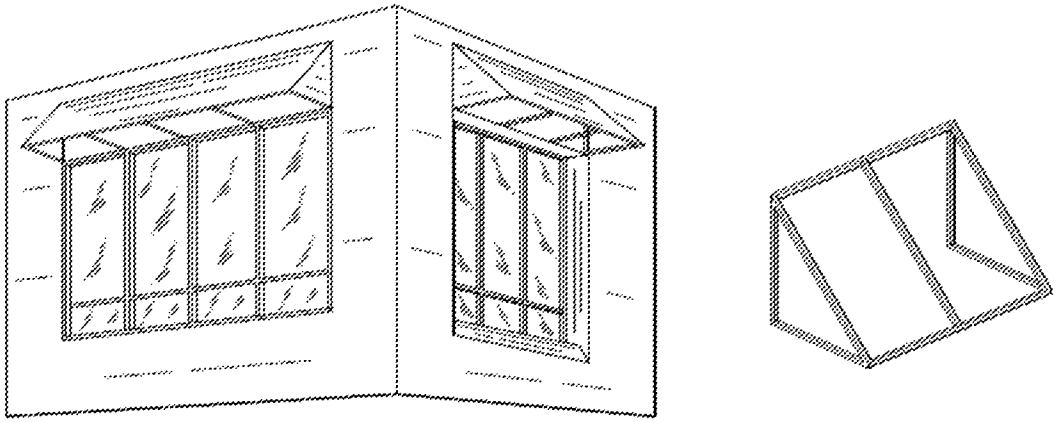
FIG. 2C shows a system with a standard frame.
Figure 2D:
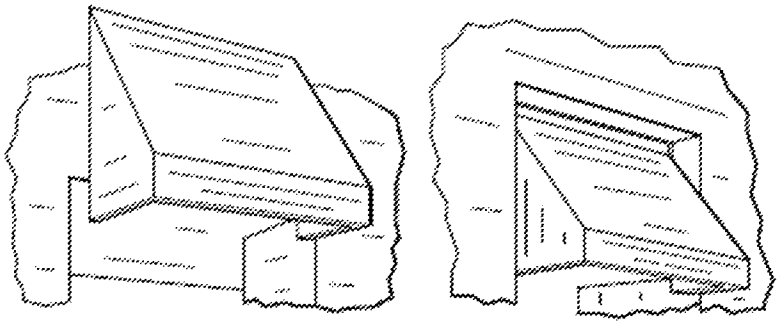
FIG. 2D shows a system with a shed frame.
Figure 2D:
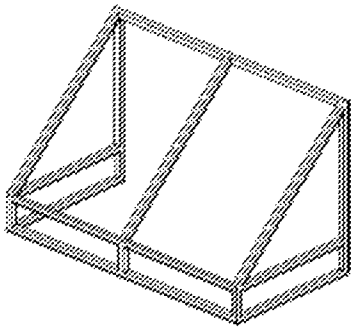

FIG. 2A shows a system 100 with a lean-to frame 102. FIG. 2B shows a system 100 with a lean-to rigid valence frame 102. FIG. 2C shows a system 100 with a standard frame 102. FIG. 2D shows a system 100 with a shed frame 102.

Figure 3:
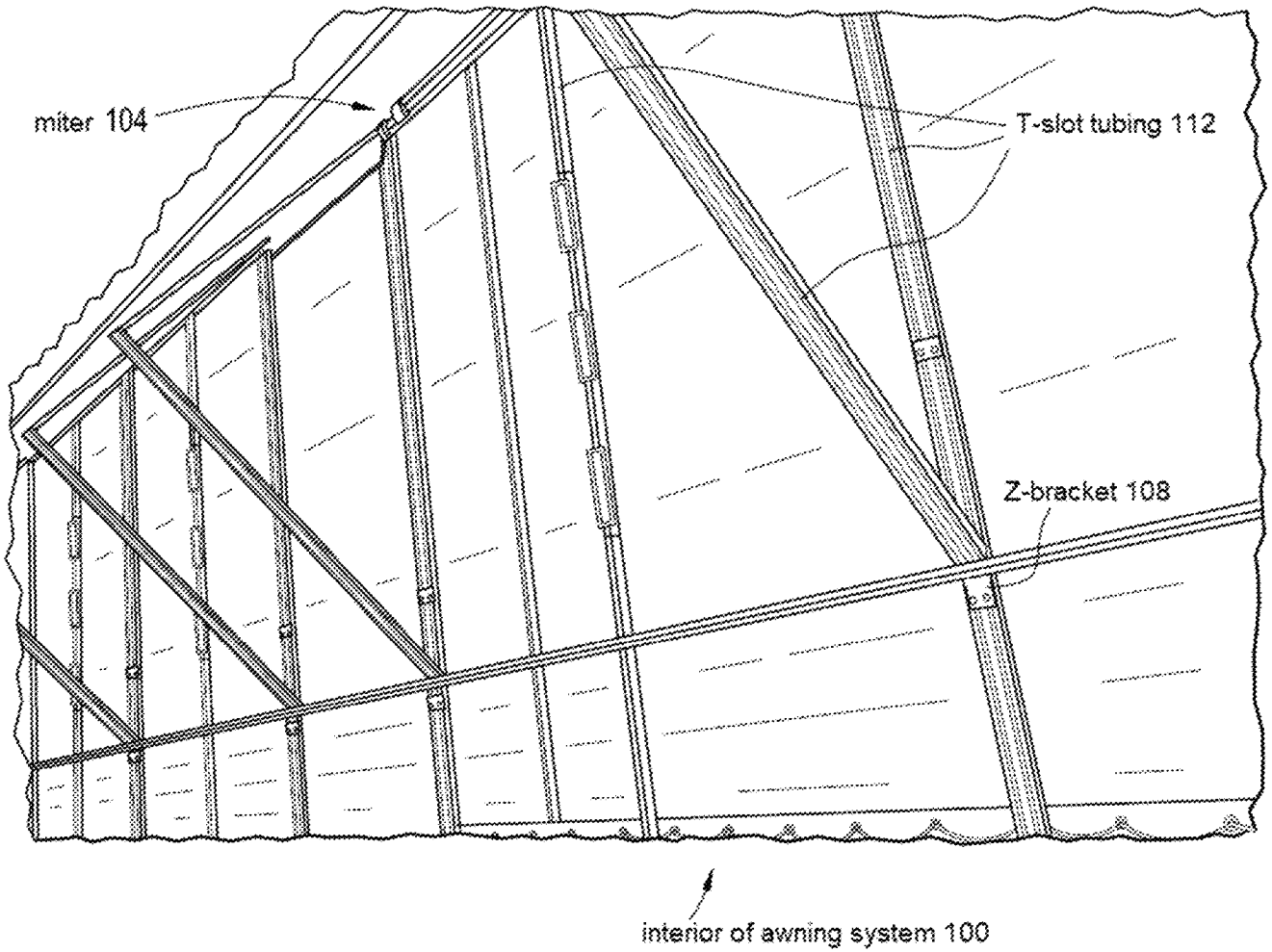
FIG. 3 shows details of an example awning system.

FIG. 3 shows details of an example awning system 100, using an interior view. As shown in FIG. 3, the miter connector 104 works with the Z-bracket 108 and the T-slot tubing 112. The specific frame 102 of the awning system 100 shown in FIG. 3 is a variation of the "lean to" frame 102 shown in FIG. 2A, except that in FIG. 3, the projection arms are not parallel with the ground. The Z-bracket 108 fits within a vertical portion of T-slot tubing 112 to ensure that the projection arms of the frame 102 do not descend any further downward, but instead remain in place.

Within the various embodiments of the awning system 100, the adaptive, reuseable, and interchangeable hardware described herein can be adjusted to a variety of sizes and styles. Most important, this can be done without the use of permanent weld bonding or sealants. This facilitates ability to create an awning system 100 for any patio, window, and\or entranceway, using sturdy, lightweight, non-corrosive parts that can be built on-site. This provides advantages in shipping and assembly, but without compromising project design.

The awning system 100 can be used on any exterior of any building, although the anchor bolts and concrete drilling should be already in-place.

The awning system 100 is implemented using a variety of durable, strong, weld-like frames 102. The awning system 100 is non-corrosive and will not rust. Also, the awning system 100 uses lightweight, high performance hardware with an anodized finish for long-lasting usage. The awning system 100 also uses anti-vibration reduction design advanced extrusion technology, which buffers high winds on exteriors.

The miter connector 104 is specifically designed for convenient fabric overlay, creating a smooth finish while successfully emulating e.g. welded frame awning styles currently on the market. As such, with the embodiments disclosed herein, there is no need for anyone to alter their aesthetic tastes or preferences. The old can become the new, just easier to work with (under the fabric). This means the rigidity, inflexibility, and shipping problems of conventional welded frames is eliminated.

Furthermore, current methods of awning fabric construction and installation can still be utilized with the awning system 100, making an easy transition to the awning system 100 as a costwise and environmentally conscious choice. For example, the awning system 100 can be installed in conjunction with an existing awning arrangement, which is an advantage. In an embodiment, the system 100 can use 1×1 T-slot tubing 112. In an embodiment, the T-slot tubing 112 can be formed from aluminum. Also, sizes other that 1×1 can be used. 1×1 is discussed herein for illustration only and should not be considered limiting. The clamps and wall screws already presently in use to install existing awnings use various clamps and bolts that are known. As such, a transfer of the same parts to be used within the system 100 can be done at any moment.

In an embodiment, the system 100 utilizes one of several series of wall J-clamps designed for the various frames 102 that slide easily into the slots or grooves 412 located on the T-slot tubing 112. Such an arrangement prevents the frame 102 from loosening in case of high winds or upon any shocks. Such an arrangement also allows an anti-vibration process to be maintained. The J-clamps fasten to a wall with singular hole in its base (not shown) where a user locates a wall mounting screw to secure the J-clamp and frame 102 to a wall, using no screws to penetrate the metal or other composition of the components of the frame 102, unlike existing Z-clamps used for the same reason. The system 100 uses no screws to penetrate extrusion tubing 112, instead holding the frame 102 in place on a wall with clamps.

The proprietary J-clamps of the system 100 allow the frame 102 to be installed faster, easier, and re-used over and over again on another project with no loss of mechanical integrity or strength. When utilizing standard Z-clamps to hang them on walls, conventional frames require screw holes which penetrate the metal right at the top bar where the Z-clamps and framing metal meet. This degrades the mechanical integrity of the overall structure.

Figure 4B:
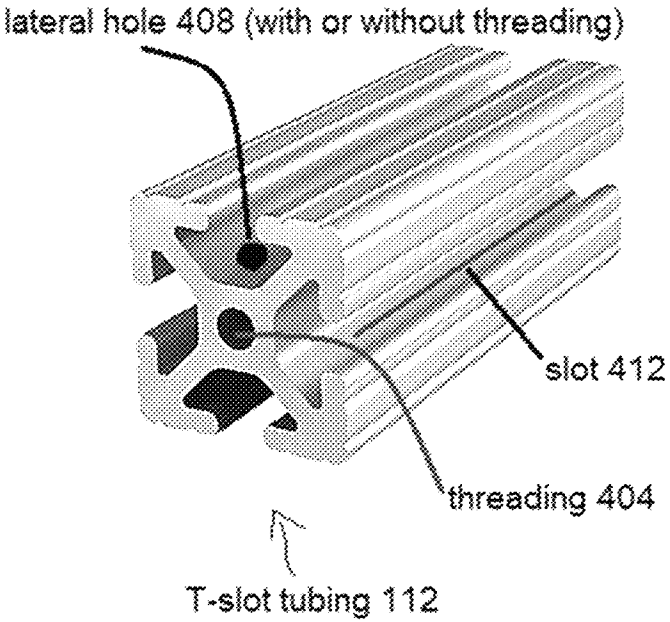
FIG. 4B shows an embodiment of proprietary T-slot tubing.
Figure 4A:
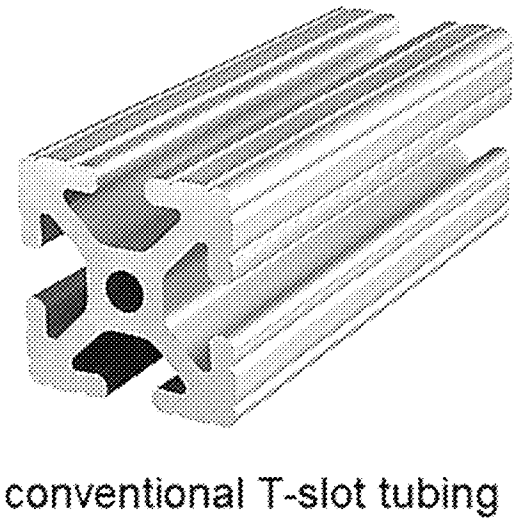
FIG. 4A (prior art)
FIG. 4A shows a prior art T-slot tubing.
Figure 5A:
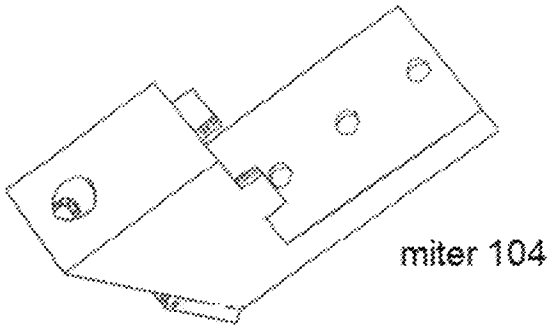
FIGS. 5A-5D and 6A-6F show various views of a miter connector.
Figure 5B:
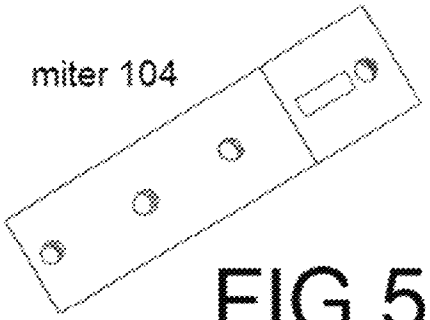
Figure 5C:
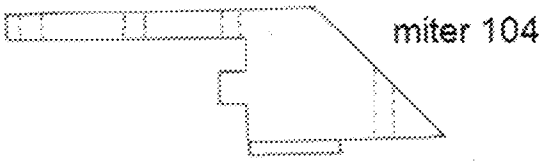
Figure 5D:
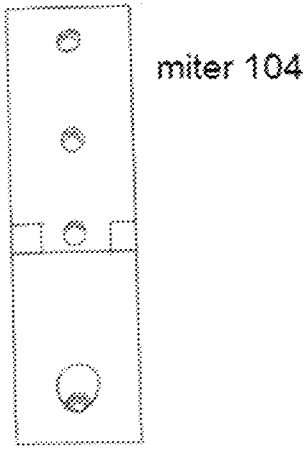
Figure 6C:
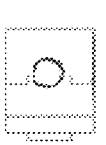
Figure 6B:
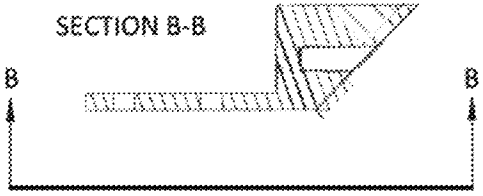
Figure 6E:
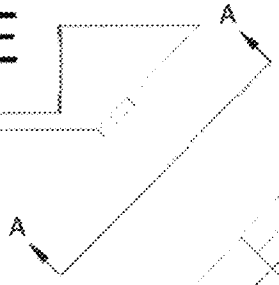
Figure 6F:
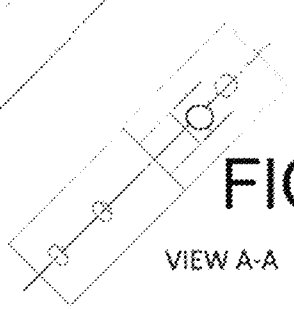
Figure 6A:
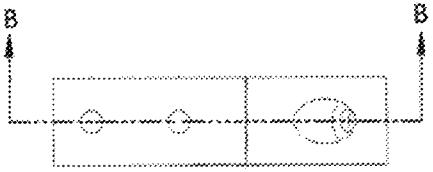
Figure 6D:
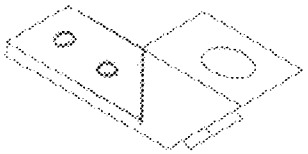

FIG. 4A shows an example of conventional prior art T-slot tubing. Meanwhile, FIG. 4B shows an embodiment of proprietary T-slot tubing 112, in which threading 404 and a threaded hole 408 are implemented. The threaded hole 408 is located in one of the four slots 412 that are always found within the proprietary T-slot tubing 112. Various fastening agents (see FIG. 9, e.g. end clips 904 and slot nuts 908) are utilized inside and outside of surfaces of the T-slot tubing 112 and inserted within, or connected to numerous cut slots located on T-slot tubing 112. This allows for the plates and fastening agents to connect and slide into a position, which, once tightened, create a strong bond at the grooves, corners, and surface areas of the frame 102.

Various slot nuts (e.g. FIG. 9) locate themselves within the slots 412 within the T-slot extrusion\tubing 112 which is curved at its inner base, so that movement is possible in a slight way when bolted into position. When a shock is applied somewhere on the system 100, the bolts thus have room to adjust themselves back to its original position and when bolted with screws they act as absorption control because of their slight movability. Also, the end clips have a curved edge which act as a type of cushion and a mechanical buffer, by taking outside vibration and absorbing it, and staying sandwiched together between the end joints of the T-slot tubing 112.

The system 100 implements the T-slot tubing 112 in such a way as to retain a smooth finished edges to stretch fabric over the frame 102, thereby emulating and facilitating awning designs currently on the market. Standard methods for putting up awnings need smooth edges after welding, because the fabric will rip or tear during installation process, and/or after its been on a wall for several years. Smoothing and deburring edges after welding requires additional time, labor, and craftsmanship. The fabric's warranty from a supplier has to be maintained as well. As such, upon installation, the system 100 must employ the same principles. The non-welded frames 102 within the system 100 create several awning looks without the need to weld the extrusion together makes creating smooth edges easier, which in turn prevents tearing of fabric.

When the T-slot tubing 112 is cut in angles with saw or blade, rough edges are created which can potentially rip or tear fabric material. Further, a deburring process may not entirely remove these rough edges. So instead of the welding process, the system 100 connects the cut ends together without a weld and connects them together. The miter connectors 104 substitute for that welded connection, thereby giving the smooth finish needed to protect the fabric as it is installed onto the frame 102. This type of finish creates a frame 102 which has adjustability, can be dismantled and positioned differently at any moment and angle, and yet does not rip or tear fabric in doing so.

FIGS. 5A-5D and 6A-6F show various views of the miter connector 104. The miter connector 104 can be made from, for example, linear extrusion technology, although other techniques can also be used, such as 3D printing. In the case of 3D printing, the filament used must result in a very high resiliency and durability, as the miter connector 104 must withstand significant stress and torsion both during installation and during use. No welding is needed to complete the frame 102 within the awning system 100. Instead, the interlocking miter connector 104 is pre-cut & sized with various counterbored holes (see e.g. FIGS. 5A-5D and 6A-6F), to match with for example the threading 404 and the threaded hole 408 within the proprietary T-slot tubing 112. This results in the awning system 100 having on-site adjustability, and movable parts which accommodate all wall surfaces without compromising physical integrity. This also acts to eliminate or overcome mistakes in measurements, which in conventional awnings can be very costly just in construction delays alone.

Additionally, knowing that the system 100 may be installed by a person with limited skill, the various counterbored holes within the miter connector 104 are equipped with anti-thread-stripping features. This is in expectation of an occasional user over-tightening the various bolts and slots nuts 908, or other errors of mis-installing. Further, the business model of the manufacturer of the system 100 allows for quick replacement of a miter connector 104 that has been stripped or torqued or damaged to the point of being unusable.

Figure 7A:
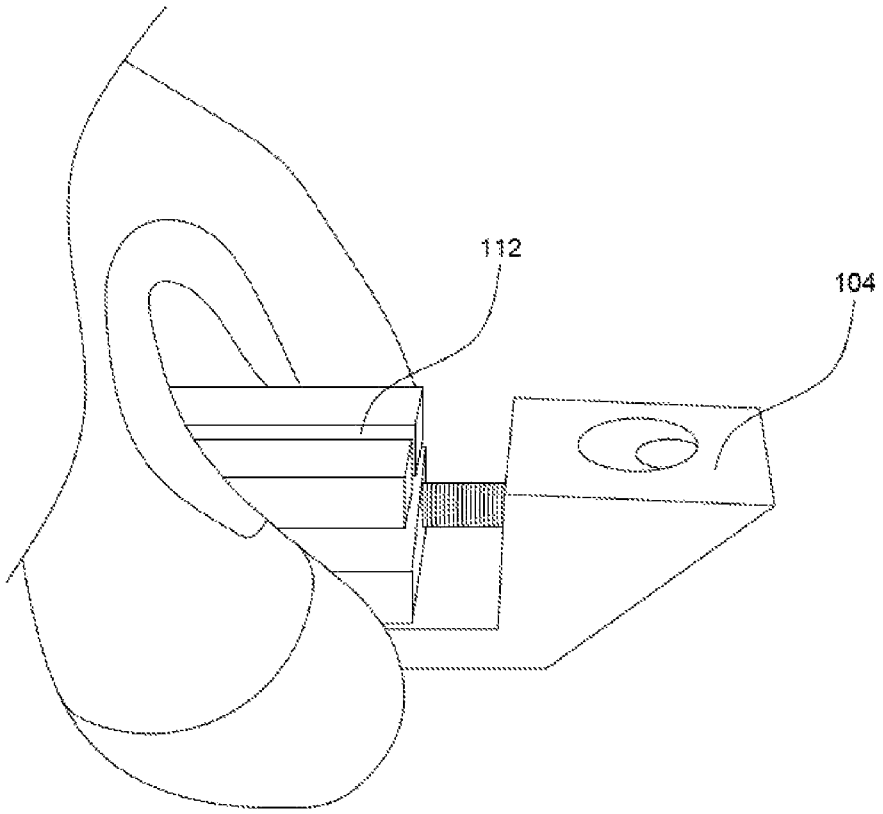
FIGS. 7A-7F show example connections of miter connector and\or T-slot tubing.
Figure 7B:
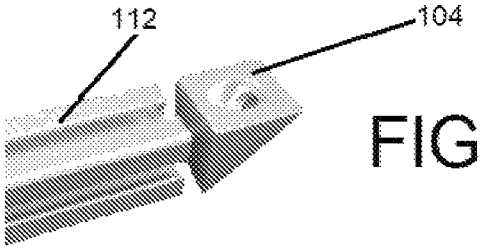
Figure 7C:
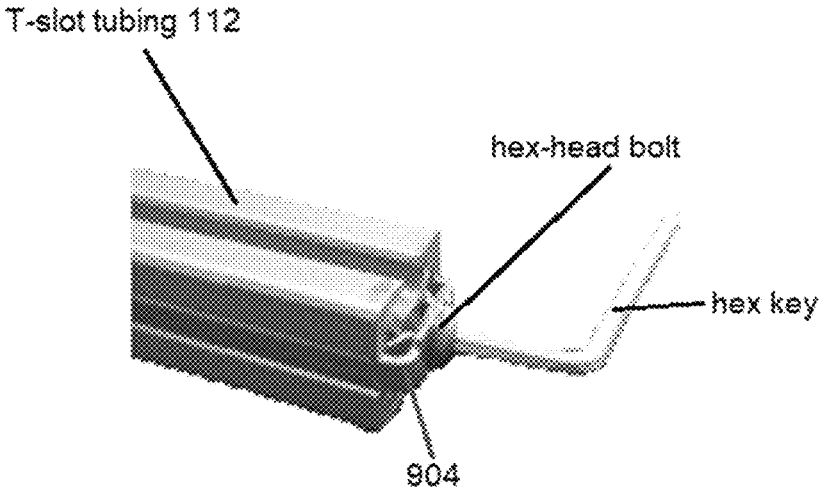
Figure 7D:
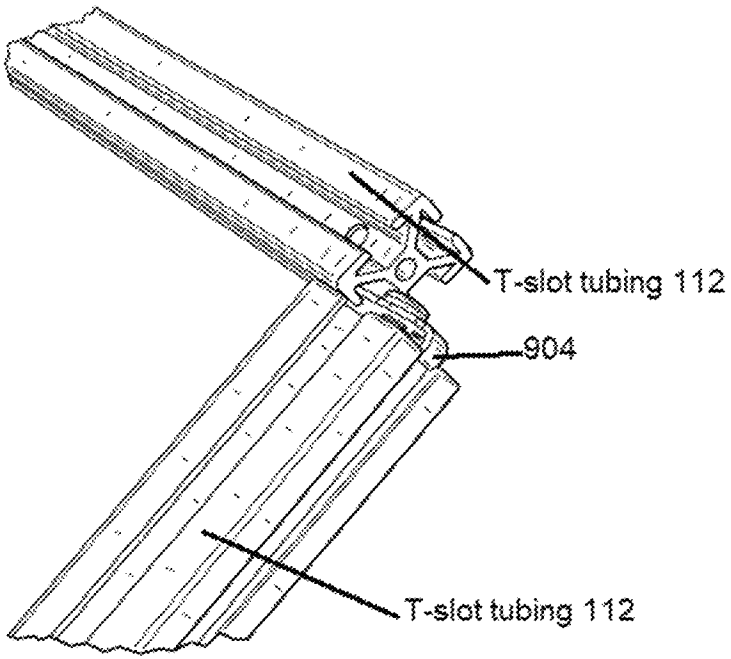
Figure 7E:
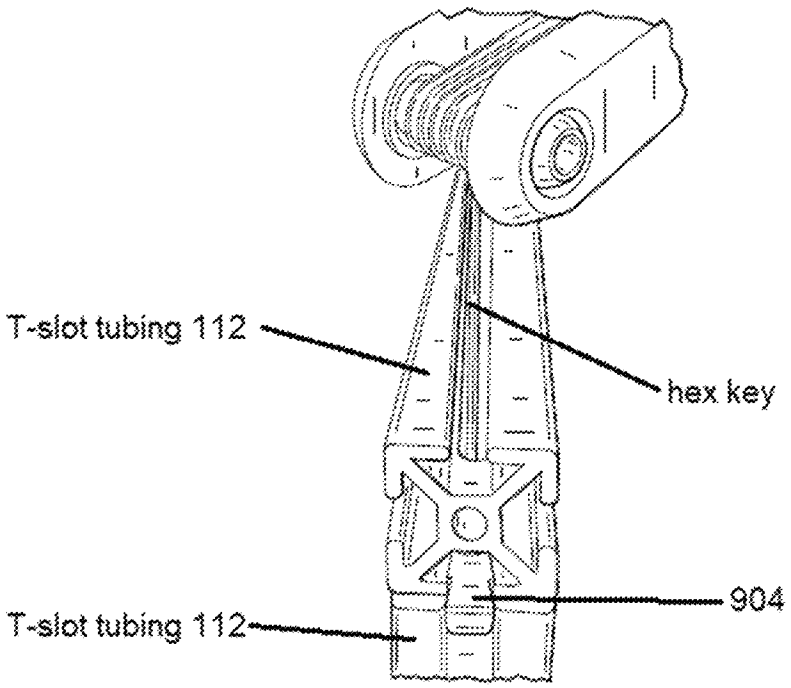
Figure 7F:
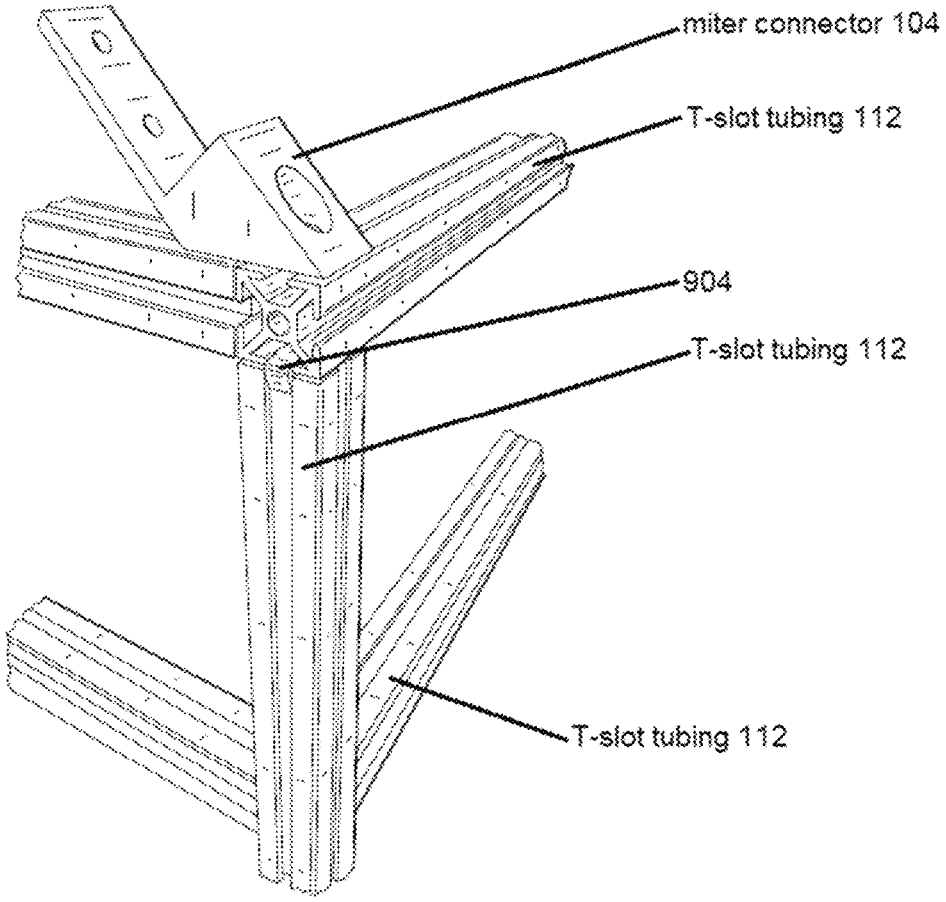

FIGS. 7A and 7B show possible connections of a miter connector 104 and T-slot tubing 112. However, FIGS. 7A and 7B are only part of the process of connecting T-slot members 112. FIGS. 7C-7F shows another connection in which various connection mechanisms (e.g. end clips 904 and slot nuts 908, see FIG. 9) are attached directly to a T-slot member 112, but in this case without a miter connector 104. Instead, in FIGS. 7C-7F, various T-slot members 112 are connected to each other in a perpendicular arrangement.

Figure 8A:
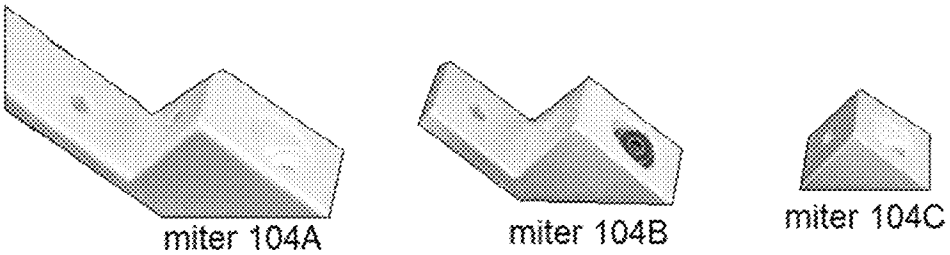
FIG. 8A shows embodiments of the miter connector.
Figure 8B:
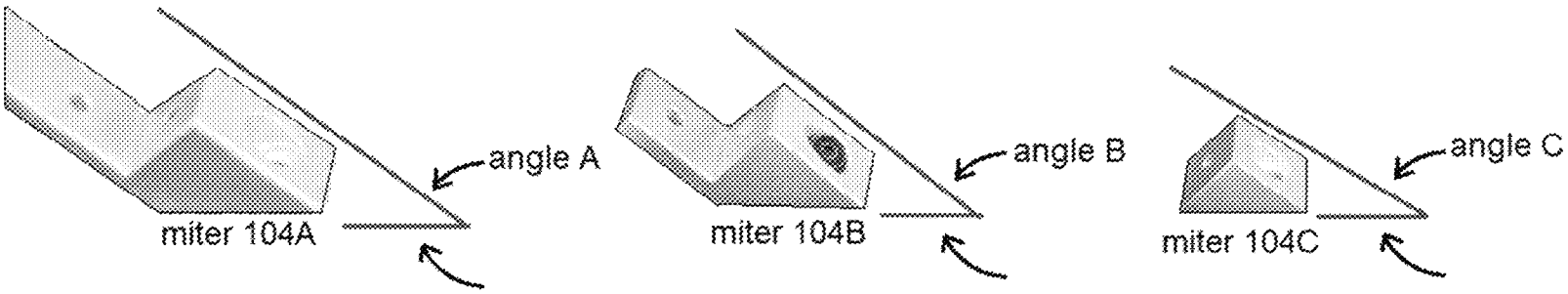
FIG. 8B shows how the embodiments of the miter connector have different angles A, B, and C, according to a desired angle of the surface of an awning.

FIG. 8A shows embodiments of the miter connector 104. FIG. 8B shows how the embodiments of the miter connector 104 shown in FIG. 8A have different surface angles A, B, and C, according to the desired angle of the surface of the awning. The miter connector 104 can for example have surface angles of 35°, 45°, or 60°, although other embodiments can also be used.

Figure 9:
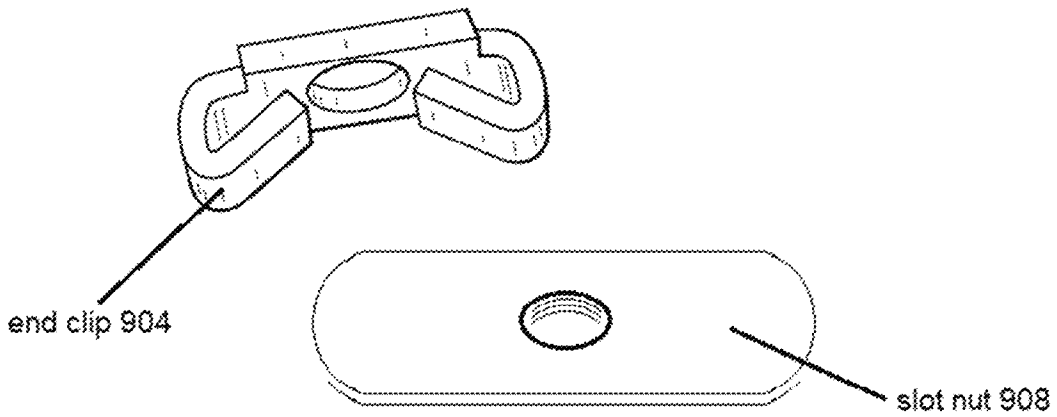
FIG. 9 shows example end clips and slot nuts.

FIG. 9 shows various connection members, e.g. end clips 904 and slot nuts 908.

Figure 10:
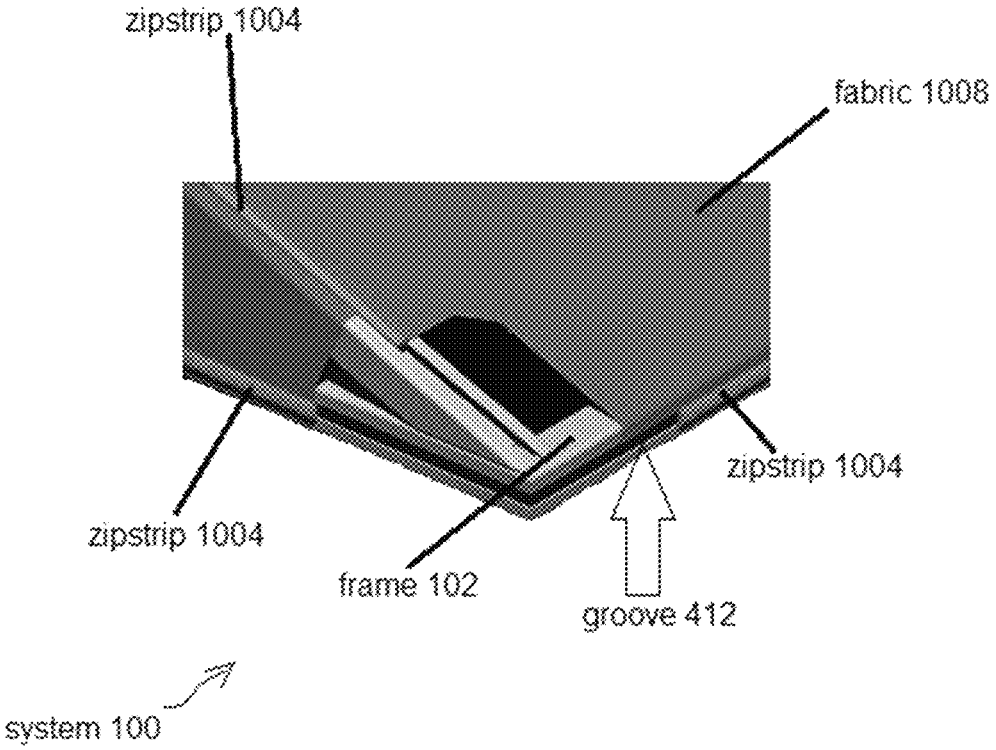
FIG. 10 shows an implementation of a zipstrip within the system.

FIG. 10 shows an embodiment of the system 100 in which a plurality of zipstrips 1004 fasten fabric 1008 to the frame 102. The zipstrips 1004 are forced into the slots 412 over the fabric 1008.

Figure 11:
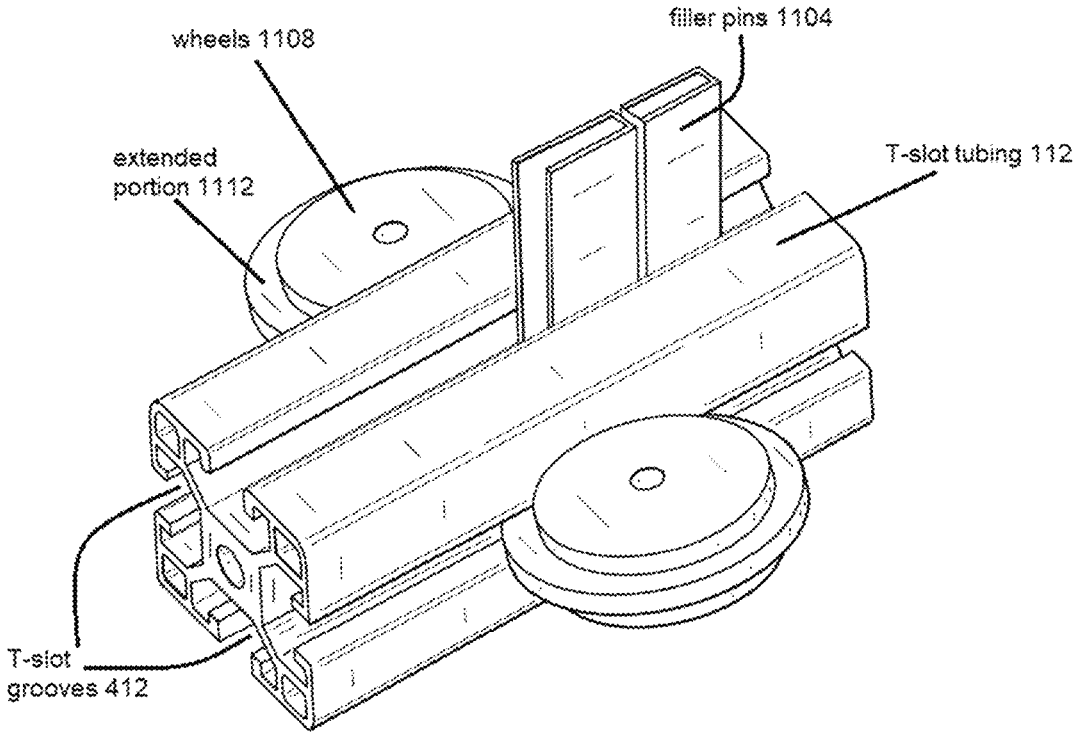
FIG. 11 shows a portion of a mechanism for bending the T-slot tubing.

FIG. 11 shows a partial view of a mechanism for bending the T-slot tubing 112 into curved portions. FIG. 1A shows some examples of possible contours for the frames 102, including some frames 102 with curved portions. In such a case, it is necessary to bend the T-slot tubing 112 which helps form the various frames 102.

The bending is done by press-type mechanisms which can simultaneously apply calibrated forces to various portions of any particular section of T-slot tubing 112 (which comes in various lengths). FIG. 11 specifically shows wheels 1108 which are located alongside the T-slot tubing 112, for guiding and ensure that the tubing 112 remains in-place during the bending process. Each of the plurality of wheels 1108 have a protruding extended surface 1112 which are intended to be movably located within the slots 412 during the bending process. This feature has at least two benefits. First, the wheels 1108 and the protruding surface 1112 prevent the T-slot tubing 112 undergoing the bending process from popping out of place. Second, the protruding surface 1112 helps to ensure that the slots 412 maintain the proper width during the bending process, and remain in-proportion to the tubing 112.

The filler pins 1104 also assist in ensure that the slots 412 maintain the proper width during the bending process, and remain in-proportion. The filler pins are movable, and can be re-located during the bending process.

Eliminating Repair Costs

Welded frame measurements must be exact, thus allowing for no errors in time & budgeting. If the welded joints are not correct, parts will need to be fixed or replaced later, costing additional time and money to refine them with no engineering flexibility.

In sharp contrast, the embodiments disclosed herein are modular with T-slots on all four sides of the T-slot tubing 112 (see FIG. 4), which contributes to making the awning system 100 adjustable anytime, anywhere. Further, the embodiments disclosed herein include custom-manufactured exterior shade and water resistant structures.

The system 100 utilizes a sewn method when joining two pieces of fabric together. One non-limiting way to achieve this is by sewing two pieces together at their edges, then flipping the fabric inside out to do a top finish seam. Afterwards, slightly pushing the top layer fabric to its right or left, thereby creating a bump or air space under side. This method also includes stretching the fabric in all directions over a frame 102, thereby allowing a grouping of bound material with a limited tiny hole. No stitches are visible. Water is less likely to leak at this point, as there is less strain on the threads that normally pull the fabric tightly, leaving only a tiny air hole for water to leak through.

The awning system 100 also reduces errors in installation. 90% of construction installation require being finished with any install when completing the building project. Awning installers may often be forced to run late on the project, thereby delaying their final payout after a project is complete. This is largely from waiting until the last minute when the outer wall has to be stuccoed or surfaced. Especially when the awnings have to fit between columns located on exterior wall surface. When working with a contractor and have to make the awnings ready before the building is finished, this can cause measurements to be off. This is a problem because, if the awnings are welded 100% of the time, then dealing with removal, welding cost, cutting them down, strength loss, material integrity compromised, not to mention being delivered by flat bed truck or such, the various costs could become huge. The system 100 solves that because a user could literally finish early before contracted schedule is completed, or a user can elect to erect and install them at last minute. If measurements are off for some reason, users can simply unlock and trim down edges, and then re-assemble the frame 102 as though it was never cut or compromised. So in such an arrangement, the metal within the frame 102 holds its integrity, holds its strength, with no shipping cost, no welding cost or delay, etc.

As stated, the system 100 also interlocks with current awning supplies. For example, the awning system 100 can be implemented with a variety of fabrics, including for example canvas & vinyl fabrics. In the event the awning fabric is too large, or the frame 102 is too large or too small to fit fabric, users can simply adjust the frame 102 to fit the fabric. Conversely, again, standard awning frames are permanently welded and thus dis-assembleable, so the fabric will have to be re-made, thus costing hundreds of dollars. Meanwhile, the frame 102 also allows repairing older fabrics with frame 102 still attached to any wall by simply moving one or two of the rafters to the left or right out of the damaged areas, thereby way freeing up necessary space to do repair work without removal of the entire structure of the frame 102 or the fabric.

The system 100 can use conventional methods to install fabrics also, e.g. C rail, rope, screws, etc, but the methods within the system 100 take a step further by utilizing the grooves or slots 412 located within the T-slot tubing 112 to attach and secure the fabrics. This method saves hundreds of dollars on purchase of C-rail, requires no drilling, and is better than what the market currently uses, such as the previously-mentioned C-rail.

C-rail is used to allow acceptance of a plastic ¼" tubing sewn into the canvas to slide through and hold onto frame. C-rail is screwed into the back of a traditional frame's head bar located at the highest point on the frame. The frame's integrity is compromised with C-rail attachment because screws penetrate the metal and weaken its strength before installation. Aluminum is a very light soft metal so it is important that very few holes are drilled into the metal that may cause the frame to weaken and break in the event of high winds.

Conversely, with the system 100, a user can first sew ¼" tubing in canvas, then slide both into the slots 412 located on the extrusion tubing 112 at its head bar or highest point on the frame 102 to begin fitting fabric. The grooves 412 hold the fabric as the fabric tightening occurs. Further, the system 100 can use any of the grooves 412 located on 90% of the extrusion metal surfaces.

Method of Installing/Removing

With both contractors and retail customers needs in mind, the embodiments disclosed herein enable anyone to build a frame 102 quickly and easily without the use of power tools or on-site mitering. That is, the miter connector 104 comes "pre-mitered". This in turn means they can build an overall awning system 100 more quickly, as assembling and installing the frame 102 is one of the biggest tasks. Of course, it is still necessary to attach the frame 102 to the building or structure using conventional means (e.g. masonry bits, anchor bolts, etc), the embodiments disclosed herein do not eliminate that requirement.

A method exists for building a frame 102 for an awning system 100 from one size option to another size option by utilizing slotted and groove cut metal extrusion tubing (e.g. T-slot tubing 112) with interchangeable components for connecting and building the frame 102. This interchangeability allows the structure of the frame 102 to be adjusted into multiple sizes and shapes to fit any door, patio, window, walkway, enclosure, or any such areas, without need for any permanent weld or sealant.

As mentioned above, after the T-slot tubing 112, miter connector 104, and fastening agents 904, 908 are all joined together to create a frame 102, a fabric canvas cover of a particular form can then be applied to the frame 102. This is achieved using the plurality of grooves or slots 412 cut into the T-slot tubing 112 with the fastening agents 904, 908 in order to secure the canvas connection onto the frame 102 for a desired look and comfortable fit.

When a frame 102 is adjusted, lengthened, or shortened, the fabric canvas cover may be moved from one groove 412 to another groove 412 as needed. Once erected and installed, the frame 102 as constructed with all components mentioned above can also be quickly taken apart by a user, for example when loosening and removing the various components from their locations on the surfaces of the T-slot tubing 112 and slots 412. This allows the frame 102 to be separated and ready for a new design option to be initiated by utilizing same said components and same steps previously mentioned to be re-constructed and re-erected multiple times without losing durability.

The miter connector 104 provides a versatile, unique, and a necessary component used for eliminating the process of precutting groove-slotted T-slot tubing 112 in order to achieve a mitered angle finish. In conventional arrangements, most angle connections are created by cutting an angle into the groove-slotted tubes with a saw or cutter, causing danger for inexperienced individuals performing this process. Plus its awkward having to do mitering on-site. Meanwhile, within the embodiments discussed herein, the miter connector 104 allows angled (e.g. pre-mitered) edges to be created with a simple slide in and locking components which fastens into place with a mere hand tool. See e.g. FIGS. 7C, 7D, and 7E. This in turn results in solid support for T-slot tubing 112, and as a result, reduces dangerous mis-handling of tools for the inexperienced user.

Additionally, conventional, larger welded frames must be delivered by flatbed trucks costing several thousand dollars extra in shipping costs. Instead, the awning system 100 can be shipped via crate or box with a local courier service, e.g. UPS or FedEx. Further, as long as the anchor bolts are properly affixed to the structure, no power tools are required to install the awning system 100, instead it installs with an Allen wrench. See e.g. FIGS. 7C, 7D, and 7E. Also, due to the four-sided modular slots 412 within the T-slot tubing 112, patio drop curtains, or valances, can easily be added to any embodiment of the awning system 100. Thus, the system 100 is more customizable and configurable.

Improved Lifespan, Re-Usability, Configurability, Adjustability

The miter connector 104 joins multiple T-slot tubes 112 at a variety of angles, thereby creating a smooth mitered edge for various construction designs of the frame 102. This results in continuous reusable and adjustable features while maintaining the integrity of the miter connector 104 and T-slot tubing 112 when fastened. This provides continued use of non-damaged parts which can save time and money when used as an alternative for mitering. The miter connector 104 exists as the fastest and most efficient way to create desired angles for a required finished edge.

The miter connector 104 acts as a fastening component to achieve a smooth edge to replace machine cutting with miter angles. In conventional awnings, a step of machine cutting is necessary to complete prior to construction of awning implementations that require a miter finish. Conversely, within the awning system 100, the miter connector 104 with its interlocking features consisting of various tooled notches, pre-mitering, and cuts at various places, is used for sliding into position on T-slot tubing 112. This is suitable for bracing, supporting, and joining together round or square groove-slotted tubing by easily inserting and connecting onto the edges 412 or body of the T-slot tubing 112 or body and allowing adjustments into several angled degrees and position options when fastening together one or more T-slot tubes 112.

The miter connector 104 can also be quickly removed by loosening and removing the locking components and re-used to create various styled structures from the T-slot tubing 112 repeatedly, without compromising its integrity, or the integrity of the T-slot tubing 112, yet still creating a strong weld-like bond. This is partly because of the careful manufacturing described earlier, including using raw materials that can withstand high shear and torque, and the anti-thread-stripping which sometimes occurs when an inexperienced installer over-tightens things, e.g. the fastening agents 904, 908. The miter connector 104 can be made from, at least, aluminum alloys, tungsten alloys, steel combinations, and even potentially 3D printing (assuming a high durability filament and lots of energy to run the 3D printer). It is advantageous for the miter connector 104 to withstand the stresses of hole-drilling and tapping without deformation, and must also resist a wide variety of weather conditions.

Within the awning system 100, the frame 102 with its interlocking components can be assembled by an end user without the use of permanent weld bonding and sealants. These non-permanent locking components provide users the ability to adjust the frame 102 quickly and rearrange it into a variety of sizes and styles. This in turn enables creating a larger or smaller frame 102 construction with reusable and interchangeable components and without compromising the integrity of its entire structure when disassembled and reassembled. Also, the awning system 100 disclosed herein can be disassembled into smaller handling parts for easy transport from one location to the next location, to be for example reinstalled if desired.

As such, the various awning systems 100 disclosed herein provide a cheaper, faster and even easier way to assemble awning frames for lay persons and professional users alike, comprising sturdy, lightweight, non-corrosive parts that are adaptable and environmentally friendly because of their repeated long-term use and interchangeability.

Another advantage of the embodiments disclosed herein is configurability. In conventional systems, the awnings arrive pre-welded and cannot be disassembled. Meanwhile, the embodiments disclosed herein can be disassembled and re-installed according to unique and specific individual circumstances. This leads to increased flexibility during installation, increased ability to recover from mistakes, misunderstandings, or changes, and decreased contractor costs, construction costs, hourly labor costs, and costs due to delays.

Additionally, in some cases, purchasers of awnings (e.g. building managers, property managers) may make selections based on what they expect will have good visual appeal. However, it is possible to make a mistake, to choose unwisely, and to admit that a certain design looked good in the catalog and on the website, but just does not work in actual practice, that is, in actual construction. As such, the embodiments disclosed herein are more flexible, can accommodate more errors and mis-purchases and misunderstandings, and can be disassembled more easily and re-installed, often in the same day.

For example, it is possible that a purchaser orders an awning system having a surface angle of 45 degrees. All aspects of the ordering process and installation process could go perfectly well, but then the purchaser realizes, only after seeing the system 100 on his building, that he was in error. In such a case, the 45 degree miter connector 104 could be removed, and replaced with a 60 degree miter connector 104 (see FIG. 8B). The property manager could thus quickly re-assess the visual impact of his choice, using a different angle.

Another area which affects the visual impact of an awning is in how and where the awning system is fastened and connected. The options and variations built into the manufacturing and installing of the awning system 100 are described in more detail elsewhere within this disclosure. The important point is having the ability to shift and re-configure the awning system 100 "on-the-fly", as this increases the likelihood of satisfaction for the end-user or end-purchaser.

Disclaimers\Non-Limitations

Any methods disclosed herein comprise one or more steps or actions for performing the described method. The method steps and/or actions can be interchanged with one another. In other words, unless a specific order of steps or actions is required for proper operation of the embodiment, the order and/or use of specific steps and/or actions can be modified.

In the above description of embodiments, various features are sometimes grouped together in a single embodiment, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

While specific embodiments and applications of the present invention have been illustrated and described, it is to be understood that the invention is not limited to the precise configuration and components disclosed herein. Various modifications, changes, and variations which will be apparent to those skilled in the art are made in the arrangement, operation, and details of the methods and systems of the present invention disclosed herein without departing from the spirit and scope of the invention.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method of configuring and installing an awning, the method comprising the steps of:

tapping a plurality of threaded holes in each one of a plurality of miter connectors;

configuring each T-slot tubing member of a plurality of T-slot tubing members to have four sides along a major longitudinal length, configuring each of the four sides to include a T-slot extending an entirety of the major longitudinal length via extrusion, configuring each T-slot tubing member to have a first end with a first threaded hole tapped into a center of the first end along the major longitudinal length, and further configuring each T-slot tubing member to have a second end with a second threaded hole tapped into a center of the second end along the major longitudinal length;

shipping the plurality of T-slot tubing members, the plurality of miter connectors, a plurality of slot nuts, a plurality of end clips, and fabric with a zipstrip incorporated therein to an installation site in a separated and an unassembled state;

after arriving at the installation site, securely fastening the plurality of T-slot tubing members, the plurality of miter connectors, the plurality of slot nuts, and the plurality of end clips together into a non-welded awning frame without a weld so that the non-welded awning frame can still be adjusted in size and style, wherein said step of securely fastening includes fastening two of the T-slot tubing members with one of said miter connectors so that an angle between the major longitudinal lengths of said two of the T-slot tubing members is 35, 45, or 60 degrees;

securing the non-welded awning frame to an awning location on a pre-existing building at the installation site by sliding a fastener into at least one of said T-slots; and forcing the zipstrip into at least one of said T-slots to fasten the fabric onto the non-welded awning frame to form the awning without using a weld.

2. The method of claim 1, further comprising the step of:

configuring at least one of the threaded holes of at least one of the miter connectors to be perpendicular to the major longitudinal axis of at least one of the T-slot tubing members.

3. The method of claim 1, further comprising the step of:

configuring at least one of the threaded holes of at least one of the miter connectors to be parallel to the major longitudinal axis of at least one of the T-slot tubing members.

4. The method of claim 1, further comprising the steps of:

said shipping to include shipping the T-slot tubing members from a first location and shipping the miter connectors from a second location which is different from said first location.

5. The method of claim 1, further comprising the step of:

equipping one or more of the threaded holes with anti-thread-stripping features.

6. The method of claim 1, further comprising the steps of:

pulling and tightening one or more sections of the fabric over surfaces of the non-welded awning frame.

7. The method of claim 1, further comprising the step of:

replacing one or more of the miter connectors after discovering damage.

8. The method of claim 1, further comprising the step of:

re-assembling the non-welded awning frame.

* * * * *